US005348197A

United States Patent [19]

Mizzi et al.

[11] Patent Number: 5,348,197

[45] Date of Patent: Sep. 20, 1994

[54] AEROSOL CONTAINER HAVING A SIDE COUPLED PUMP MODULE

[75] Inventors: John V. Mizzi; Donald A. Merte, both of Poughkeepsie, N.Y.

[73] Assignee: Omnific International Inc., Poughkeepsie, N.Y.

[21] Appl. No.: 934,779

[22] Filed: Aug. 24, 1992

[51] Int. Cl.[5] ..... B05B 9/00

[52] U.S. Cl. ..... 222/401; 222/209; 239/363; 239/373; 239/355

[58] Field of Search ..... 222/209, 401, 402.1; 239/337, 355, 357, 360, 363, 373

[56] References Cited

U.S. PATENT DOCUMENTS 3,995,779 12/1976 Mizzi ..... 222/401
4,147,284 4/1979 Mizzi ..... 222/401
4,763,818 8/1988 Stefano et al. ..... 222/209

FOREIGN PATENT DOCUMENTS 0338844 10/1989 European Pat. Off. ..... 222/401

*Primary Examiner*—Andres Kashnikow
*Assistant Examiner*—Anthoula Pomrening
*Attorney, Agent, or Firm*—Alfred M. Walker

[57] ABSTRACT

The present invention includes an improved apparatus for discharging liquids in a spray, including a recyclable liquid module containing a liquid to be sprayed, and a separable pump module containing an air compressor or pump driven by a weight activated by shaking the device in an essentially vertical direction. The liquid stand alone module is side coupled by a common wall with the pump module with a coupling extension providing a connection between the two modules for the transfer of compressed air from the pump module to the liquid module. Since the outlet check valve of the pump is located within the liquid module, the liquid module remains pressurized even with the pump module detached. A fluid conduit within the liquid module conducts the fluid to be sprayed to the outlet valve for discharge under the influence of the compressed air.

15 Claims, 6 Drawing Sheets

FIG. 3
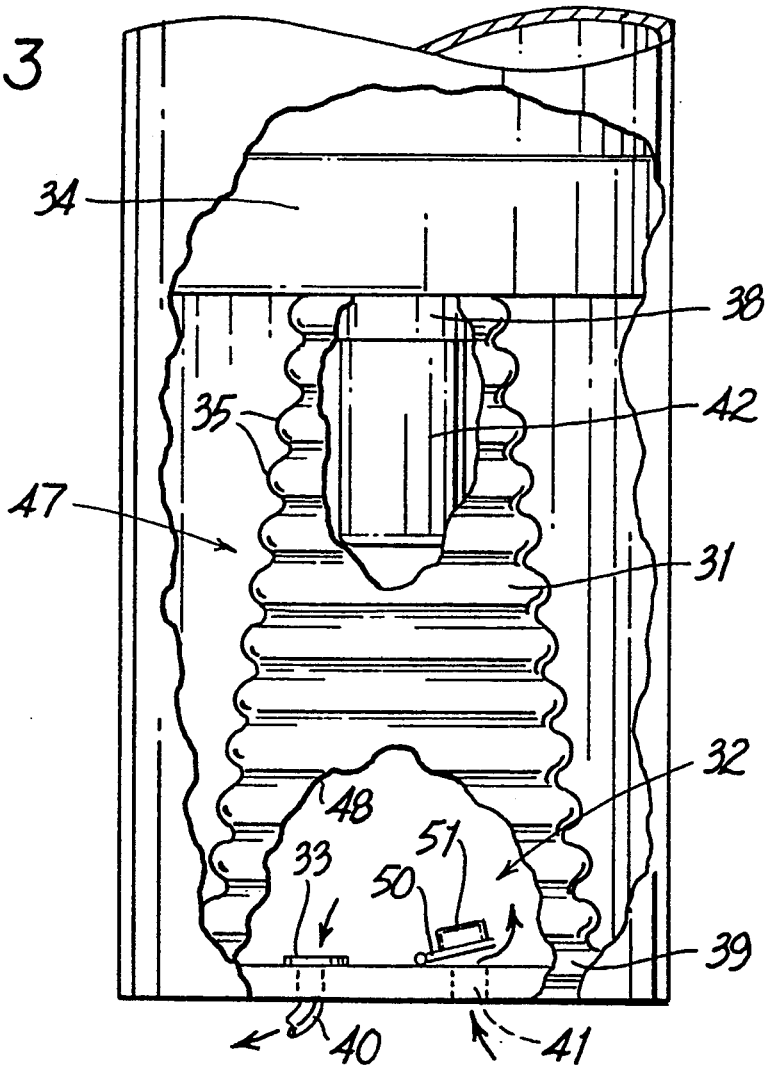
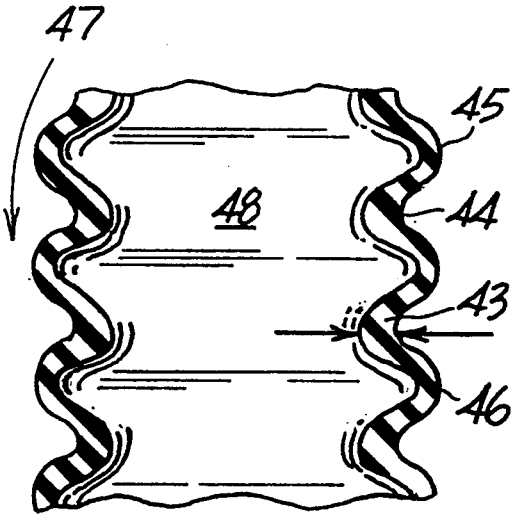
FIG. 3A
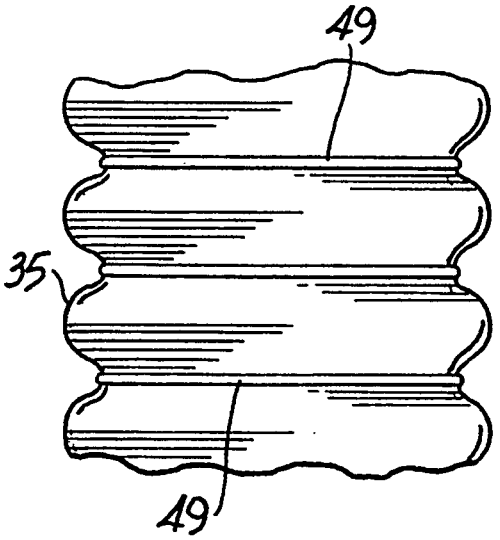
FIG. 3B

AEROSOL CONTAINER HAVING A SIDE COUPLED PUMP MODULE

BACKGROUND OF THE INVENTION

The present invention relates to an aerosol dispenser which uses compressed air as the propellant. The adoption of this dispenser as a substitute for ordinary household aerosols eliminates the use of chemical propellants such as chlorofluorocarbons or hydrocarbons; solid waste is also reduced. The dispenser, which uses a non-disposable compressor section coupled to a recyclable product container, uses air as the propellant. This is generated by the natural act of shaking the dispenser a few times before using which compresses air via a small pump located inside the unit.

DESCRIPTION OF THE PRIOR ART

The prior art includes U.S. Pat. Nos. 3,995,779 and 4,147,284 of the Applicant. These patents pertain to the use of compressed air to urge a liquid spray from a dispenser, instead of conventionally using a chemical propellant, which may be harmful to the environment.

SUMMARY OF THE INVENTION

The present invention improves the prior art with the following novel features. In a manner similar to FIGS. 5,6 and 7 of the Mizzi '284 patent, there is here provided a side coupled two-part dispenser with one key difference. By including the compressor outlet check valve in the product container, the pump module can be decoupled and shared with other product modules. The product module stays pressurized even when decoupled, and the liquid product remains sealed by the check valve.

A further improvement is provided in the use of tapered bellows as a pumping air compressor elements.

Generally, the present invention includes a liquid module containing a liquid to be sprayed, and a pump module with an air compressor pumping means, with the liquid spray flowing in response to urging by the compressed air.

Using a piston and cylinder type of compressor is a workable solution. However, sizing the stroke, bore and driving weight is a compromise which stacks a desire for quick pressure build-up of an unpressurized depleted container against a desire for high maximum pressure with a given weight and oscillatory frequency. A bellows would pose a similar compromise.

The piston and cylinder pumping module may be further modified with a telescoping piston and cylinder assembly. This particular assembly has three cylinders which nest into each other and a small piston. Appropriate seals must be fitted to each section and extension limits (strings) must be used to limit the excursion of each section during the fill stroke. This achieves some advantage in that with low back pressure, such as in a startup condition or in a depleted pressure situation in a product container, the entire array will be flattened to a significant height, thus compressing a large volume of air per stroke. As the back pressure quickly builds up, the down stroke force will no longer be adequate to compress the air in the largest cylinder. In effect, the large section decouples and stays dormant. The upper sections keep pumping until back pressure decouples the next section and so forth until finally, even the top solid piston "locks up" against back pressure.

The bellows analog to this approach, a tapered bellows, does not have these shortcomings. For the bellows, however, there are other design considerations which must be addressed. At high pressure, a bellows tends to billow out at the root radii instead of fold down. This tendency is more pronounced as the diameter increases. This is a problem associated with a tapered bellows, since the large convolutions are at peak pressure imposed by the smaller convolutions. One way to control this is by judicious attention to careful materials specification. This is an option strictly for injection molding. Another method is to fit external rings at the root of each of the larger convolutions. A preferred process is to take a completed bellows of any manufacture and to apply reinforcing fibers in the circumferential direction by first dipping the bellows in appropriate adhesive and then rolling on the fiber reinforcement. This thickening of selected portions of the bellows surface supplies just the right kind of anisotropic reinforcement, to resist radial expansion, while not adversely affecting the longitudinal suppleness of folding capability. In this manner, even inexpensive dip molded bellows of thin uniform cross section can be made usable for this application.

To preserve some volume per reduced stroke at the higher pressures, in a further embodiment, the narrow section of the bellows is extended a few convolutions. Unfortunately, this produces an instability in the geometry with a tendency for the bellows to bend instead of fold neatly upon compression. This problem is be solved in two complementary ways. First, the top section is made a bit wider than the design point would suggest, with shallower convolutions and a larger root diameter. This in itself reduces the tendency to bend, but it may not produce the desired high pressure. The latter capability can be restored, while at the same time insuring straight folding without bending, by fitting the top section of the tapered bellows with a short guide rod internally that takes up most of the root diameter of the extended section of small convolutions. The effective volume of this top section is reduced by the rod volume, thereby insuring high pressure results.

When either the telescoping cylinders or the tapered bellows is utilized as the pumping means, special attention is given to the design of the inlet check valve. In either a simple piston and cylinder or a straight bellows, the vacuum generated during extension is substantial and uniform during the entire intake stroke. Small resistance from the inlet check valve is easily overcome and the internal volume is quite well filled for the pressure stroke. In contrast in the variations discussed above, at higher pressures the internal volume is almost full of air at atmospheric pressures or above until the very last bit of the intake stroke. At this point a very small vacuum is formed by virtue of the slightly increased internal volume as can be predicted by gas laws. This small vacuum will not pull in more air through the normal spring loaded ball check or duckbill type valve. This makes the high pressure section of a tapered bellows ineffective, since the required small increase of air in the internal volume never enters during the "intake" stroke. A virtually zero resistance inlet check valve is required for this application. Flap valves can approach this capability but they tend to be leaky in very small sizes. The solution is a weight operated inlet check valve. The inlet stroke coincides with the container being pulled down relative to the compressor driving weight; this results in the bellows extending. Therefore the valve has a weight attached to it, such that it would open during the same motion of the bellows extending. If the opening itself is sufficiently large as to be minimally restrictive, this would result in the capability of even a slight vacuum pulling in more air. Additionally, the weight that opened the valve on the downstroke helps to seal the valve on the upstroke compression stroke. Many design configurations exist for this type of valve. They include ball type valves with ball attached weights, weighted flapper valves and any type of weighted moving seal valve.

OBJECTS OF THE INVENTION

It is an object of the invention to improve over air propellant aerosol dispensers. It is a further object to provide an improved side-by-side coupled air propellant aerosol dispenser.

It is a further object to provide an air propellant continuous spray dispenser wherein the pump module can be decoupled and shared with other liquid containers.

It is a further object to provide an air propellant continuous spray dispenser wherein the product module stays pressurized and sealed when decoupled.

It is a further object to provide a bellows pump means wherein the root radii efficiently fold without billowing out.

It is a further object to provide an air propellant continuous spray dispenser with a zero resistance check valve.

It is a further objective to provide an improvement over the prior art by maximizing the interchangeability and reuseability of the respective pumping modules and product containers.

The novel features which are considered characteristic for the invention are set forth in particular in the appended Claims. The invention, itself, however, both as to its construction and its method of operation, together with additional objects and advantages thereof, will best be understood from the following description of its specific embodiments, when read in connection with the accompanying drawings.

DESCRIPTION OF THE DRAWINGS

FIGS. 3, 3A, 3B, 3C, 3D, 3E, 3F and 3G show details of the tapered bellows portion of the pumping module of the invention.

DETAILED DESCRIPTION OF THE PREFERRED EMBODIMENT

Figure 2:
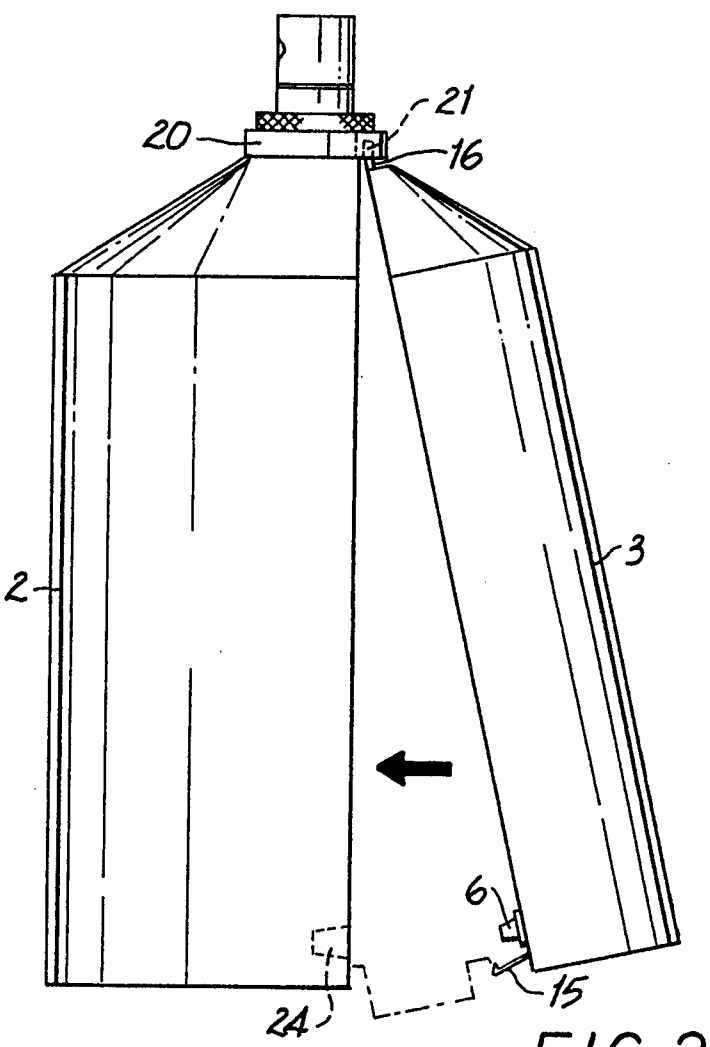
FIG. 2 is a coupling scheme view of the invention as shown in FIG. 1.
Figure 1:
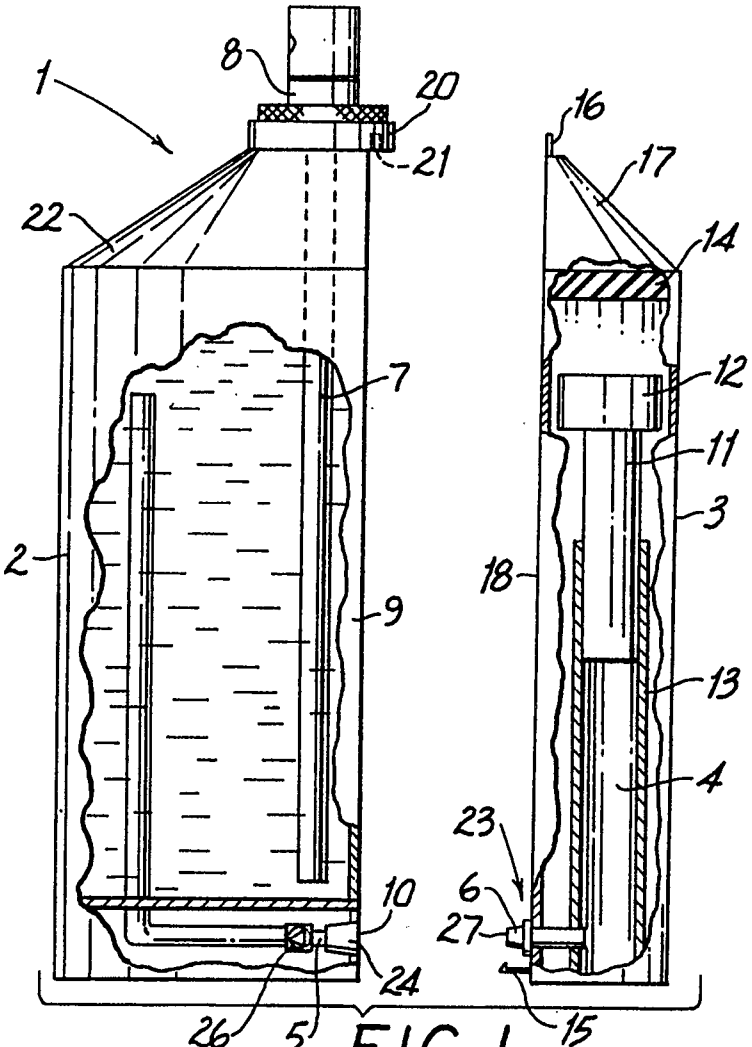
FIG. 1 is a side elevational view in section of the invention.

As shown in FIGS. 1 and 2, the present invention includes an improved apparatus 1 for discharging liquids in a spray, including a liquid module 2 containing a liquid to be sprayed; a pump module 3 containing pumping means 4, the pumping means 4 being capable of supplying compressed air; a first conduit 5 disposed within liquid module 2 and a coupling extension 6 attached to the pump module 3. The coupling extension 6 provides a connection between the pump module 3 and the liquid module 2 for the transfer of compressed air to the liquid module 2, a second conduit 7 and an outlet valve 8. The second conduit 7 conducts the liquid to be sprayed from the liquid module 2 to the outlet valve 8 for discharge, the liquid to be sprayed flowing in response to urging by the compressed air.

The liquid module 2 has at least one wall 9 and has sealable receiving means 10 disposed thereupon for sealably receiving compressed air.

The pump module 3 comprises a modular container capable of standing alone on a storage shelf, with the pumping means 4, such as a weight activated pump 11.

The weight activated pump 11 is responsive to agitation of the pump module 4, the agitation causing the weight 12 to impart sequential inertial impulses to the pump means 4 to provide a pumping action. The weight has guide means 13 and travel stop means 14, the guide means 13 allowing the weight 12 to travel freely and slidably, the travel stop means 14 providing restrictions for the freely slidable travel of the weight 12.

The pump module 3 and the liquid module 2 are conveniently attachable and detachable, the liquid module 2 further including a stand alone apparatus for discharging liquids in a spray when the liquid module 2 has been first pressurized by being conveniently attached to the pump module 3 and then conveniently detached from the pump module 3 after transfer of compressed air from pumping means 4 of the pump module 3 to the liquid module 2.

The liquid module 2 and pump module 3 have convenient attachment and release means, including a finger-operated spring-loaded latch release 15 disposed in the bottom portion of the pump module 3 and an extension tab 16 protruding from the top portion 17 of the pump module 3. When bottom latch 15 is released and the bottom end of pump module 3 is pulled away from liquid module 2, insertion member 23 is withdrawn from sealable receiving means 10. At this point, a small downward pull on pump module 3 relative to liquid module 2 releases extension tab 16 from collar tab coupling recess 21, thereby separating the two modules 2 and 3.

Figure 6:
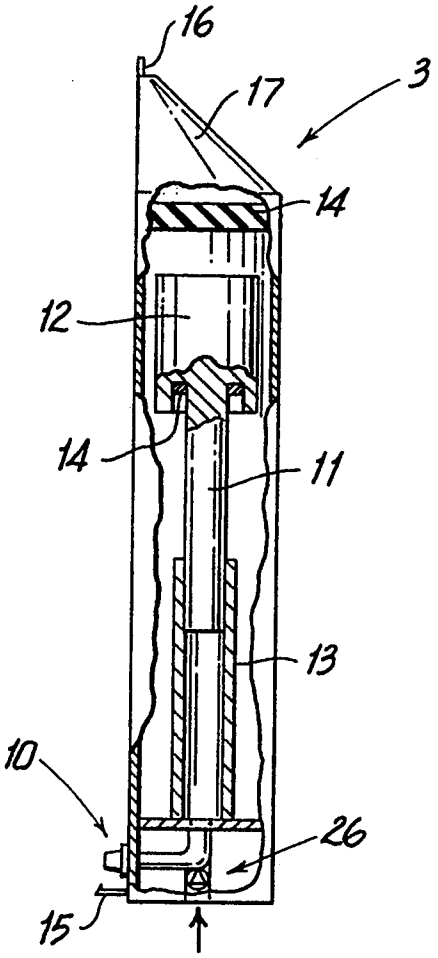
FIG. 6 is a side elevational view of a piston and cylinder pump adaptable for use in the present invention.

As shown in FIG. 6, the pump module may include a weight activated pump 11 including a piston-and-cylinder pump having a weight 12 movable within guiding means 13 for compressing air, and two check valves, including an inlet check valve and an outlet check valve, the piston being capable of compression strokes, wherein the sequential inertial impulses provided by the weight 12 drive the piston in its compression strokes.

As shown in FIG. 3, instead of the piston-and-cylinder pump means, an alternate weight activated pump includes a tapered bellows 31 and two check valves, including inlet check valve 32 and outlet check valve 33 for preventing backflow of compressed air, the tapered bellows 31 being capable of compression strokes, wherein the sequential inertial impulses provided by the weight 34 drive the tapered bellows 31 in its compression strokes.

The tapered bellows 31 includes a plurality of contiguous adjacent folded surfaces 35, each contiguous adjacent folded surface 35 being pliably capable of extensive and compressive motion relative to respective adjacent folded surfaces 35.

The plurality of contiguous adjacent folded surfaces 35 forming a pliable sealed air container having an interior 36, an exterior 37, a first end 38 and a second end 39, wherein one folded surface 35 comprises the first end 39 and one folded surface 35 comprises the second end of the tapered bellows 31, the tapered bellows 31 further having a discharge exit 40 for compressed air and an inlet 41 for ambient air to be compressed.

The tapered bellows pump means may also have an axial guidance pin 42 extending axially within tapered bellows 31 for aligning the folding of tapered bellows surfaces 35 during compression.

The tapered bellows 31 contiguous adjacent folded surfaces 35 have a thickness 43, a central portion 44 and edges 45, 46, each tapered bellows 31 continuous folded surface 35 being joined with adjacent folded surfaces 35 at the edges 45 and 46.

The tapered bellows 31 contiguous adjacent folded surfaces 35 have an exterior 47 and an interior 48, the thickness 43 being disposed therebetween, the exterior 47 of the surfaces 35 comprising the exterior 47 of the sealed air bellows container 31 and the interior 48 of the surfaces 35 comprising the interior of the sealed air bellows container 31.

The tapered bellows contiguous adjacent folded exterior surfaces 35 are provided with reinforcing fibers 49, the reinforcing fibers 49 being circumferentially and adheringly wrapped about and attached to the exterior surfaces 47, the reinforcing fibers 49 for providing dimensional and directional guidance to the tapered bellows 31 during compression.

The tapered bellows pump means has an inlet check valve 32 and an outlet check valve 33, the inlet check valve 32 having an open position, a closed position, a flap 50 capable of moving between the open and the closed position, and a weight 51 disposed upon the flap 50 for holding the flap 50 in the closed position, the weight 51 and flap 50 being movable from the closed to the open position in response to mechanical agitation of the pump module 3, and from the open to the closed position in response to gravity and the mechanical agitation of the pump module 3.

Figure 3C:
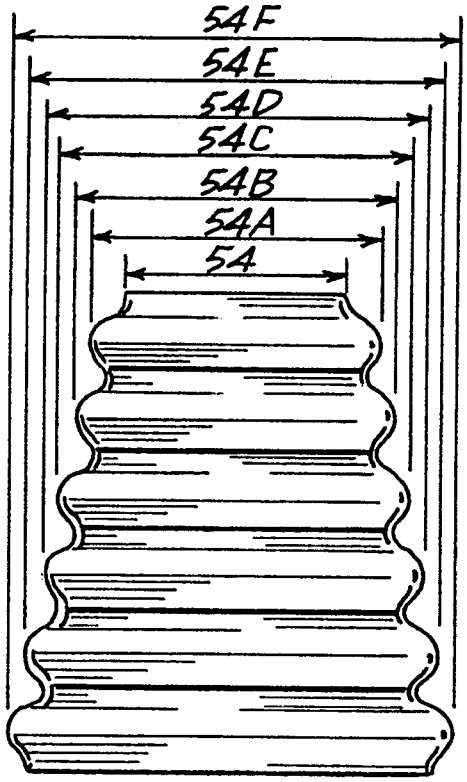
Figure 3D:
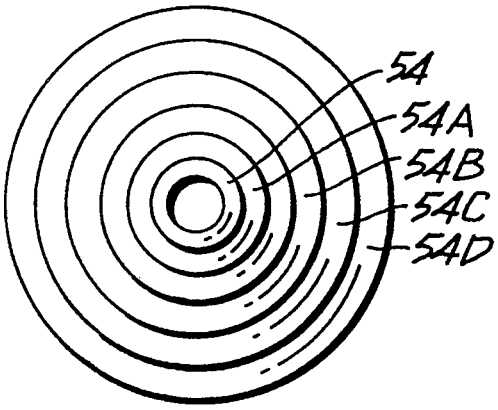
Figure 3F:
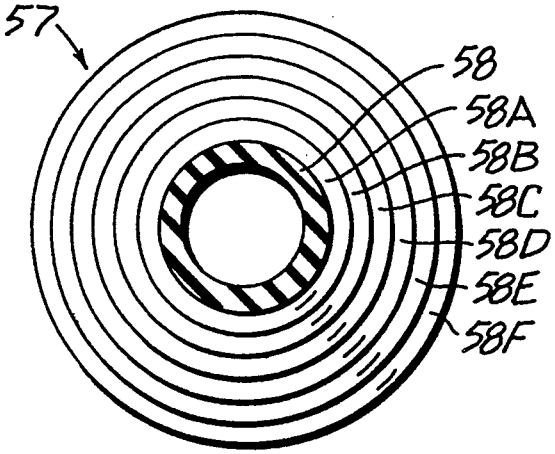
Figure 3E:
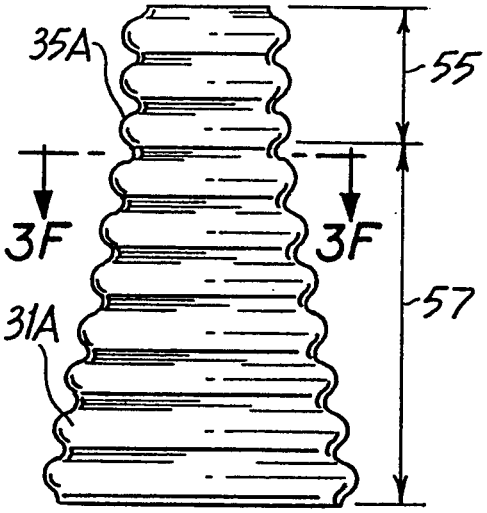
Figure 3G:
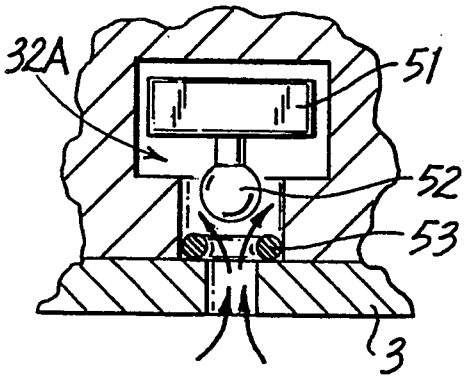
Figure 4:
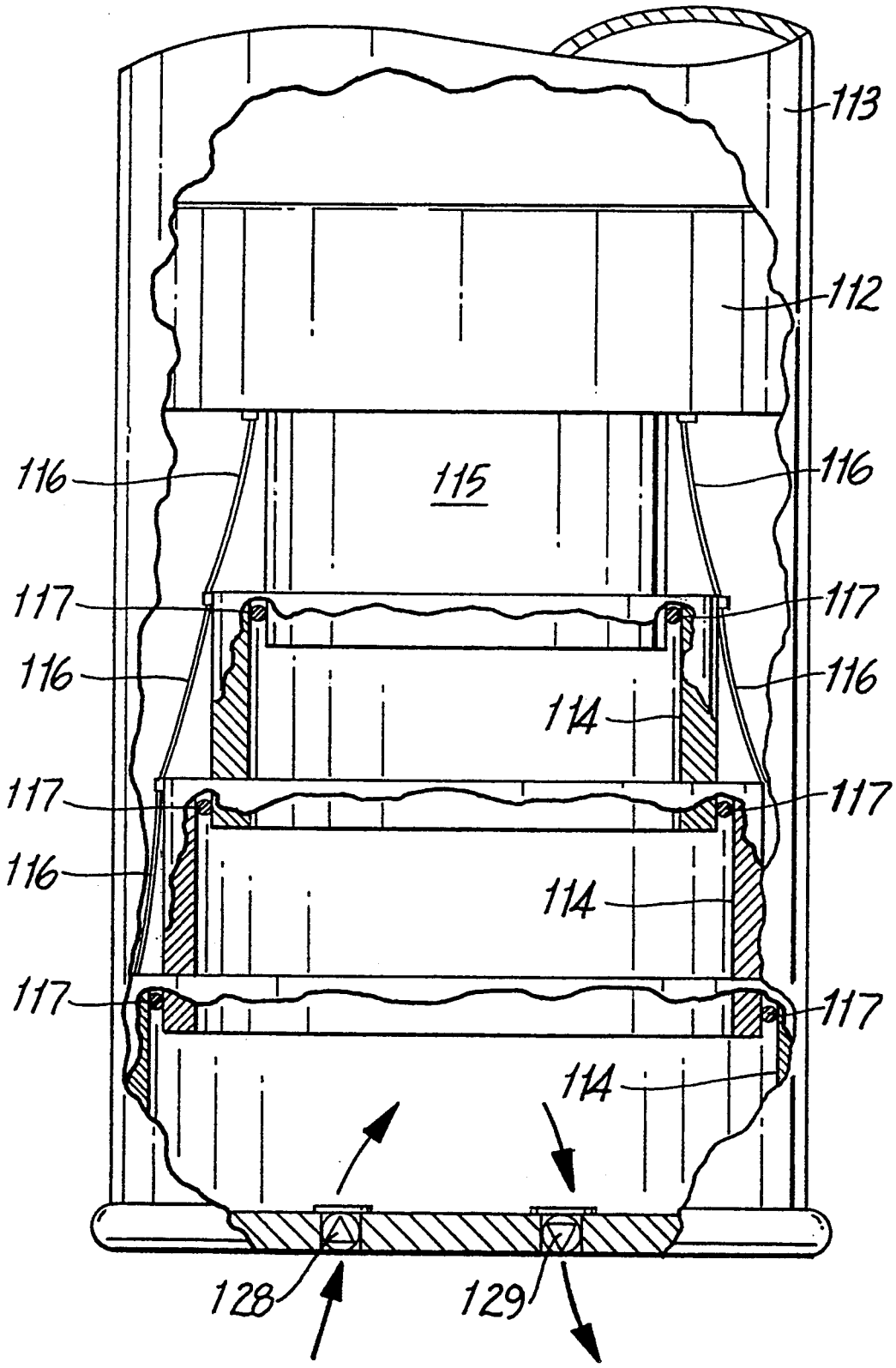
FIG. 4 is a side elevational view in section of a telescoping piston and cylinder portion of the pumping module of the invention.

Alternatively, as shown in FIG. 3G, the tapered bellows may have an inlet check valve 32A, the inlet check valve 32A having an open position and a closed position, a weight 51, and a ball 52 and O-ring 53 sealing means capable of moving between the open and the closed position. The weight 51 is for holding the O-ring 53 sealing means in the closed position. The weight 51 and O-ring 53 sealing means is movable from the closed to the open position in response to mechanical agitation of the pump module 3 and movable from the open to the closed position in response to gravity and the mechanical agitation of the pump module 3.

Figure 5:
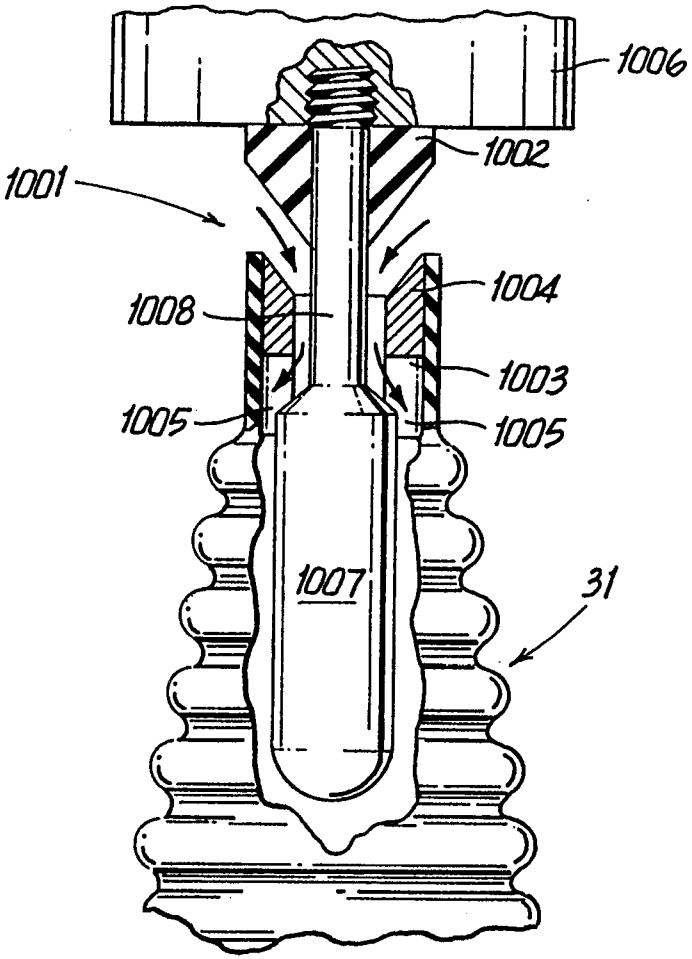
FIG. 5 is a side elevational view in section of a preferred embodiment for an inlet check valve for a tapered bellows embodiment of the pumping module of the invention.
Figure 7:
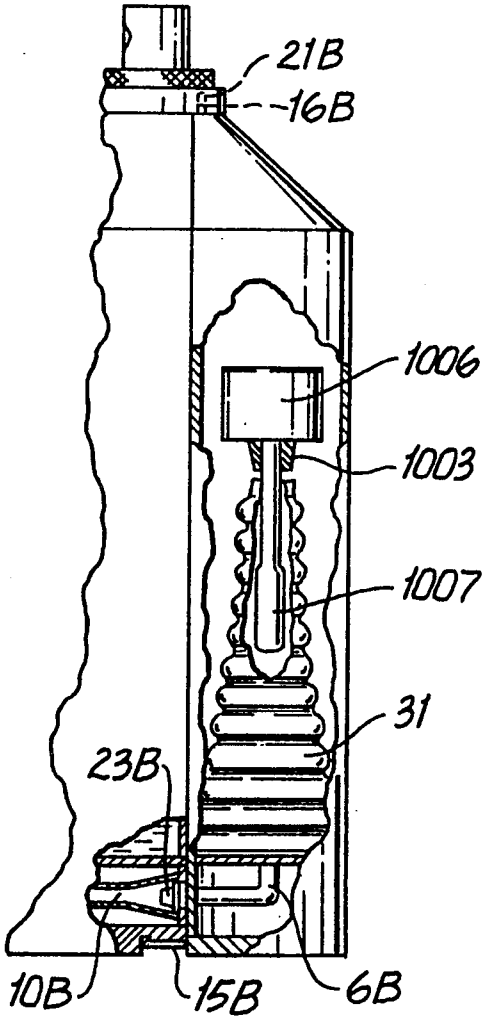
FIG. 7 is a side elevational view of an alternate bellows pump adaptable for use in the present invention.

Alternatively, as shown in FIGS. 5 and 7, the tapered bellows pump of pump module 3 may have a weight-operated bellows inlet check valve 1001, including a driving weight 1006, a relatively narrow, elongated connecting shaft 1008, and a guidance pin 1007, the connecting shaft 1008 being disposed between and connecting driving weight 1006 and guidance pin 1007, such that driving weight 1006, connecting shaft 1008, and guidance pin 1007 constitute an integral compression unit capable of vertical sealing and unsealing motion, the driving weight 1006 being disposed in a top position, the connecting shaft 1008 being disposed in a medial position, and the guidance pin 1007 being disposed in a bottom position within and relative to the integral compression unit.

The pump means further has a soft seal 1002, preferably rubber, mounted upon connecting shaft 1008 by means of a vertical bore through soft rubber seal 1002, the vertical bore sealably accepting insertion of the connecting shaft 1008 therethrough; the soft rubber seal being in an unmovable relationship to connecting shaft 1008. The pump means also has a hollow cylindrical bellows mounting collar 1003, the mounting collar 1003 further having a top and a bottom, the top further including a beveled valve seat 1004 and the bottom having beveled notches 1005, such that the soft rubber seal 1002 is inertially urged into sealable contact with beveled valve seat 1004 by driving weight 1006 during the bellows compression stroke.

The vertical sealing motion of the integral compression unit provides the compression stroke, the vertical sealing motion of the compression unit being relative to mounting collar 1003, the vertical unsealing motion of the compression unit comprising upward motion of the compression unit relative to mounting collar 1003.

As shown in FIG. 7, the air imparted by bellows weight 1006 through bellows 31 passes through coupling 6B into insertion member 23B into a corresponding coupling hole 10B in liquid module 2.

As further shown in FIG. 7, in a manner similar to the uncoupling of pump module 3 from liquid module 2 shown in FIGS. 1 and 2, pump module 3 with weight 1006 and guidance pin 1007 is released from liquid module 2, when bottom latch 15B is released and insertion member 23B is withdrawn from sealable receiving means 10B. At this point, a small downward pull on pump module 3 relative to liquid module 2 releases extension tab 16B from collar tab recess 21B, thereby separating the two modules.

As shown in FIG. 3, in operation, the weight operated bellows inlet check valve 32 permits ambient air to enter the bellows 31, in response to the unsealing motion of the compression unit and the weight operated bellows 31 compresses air within the bellows 31 in response to the sealing motion of the compression unit.

As shown in FIGS. 3C and 3D, the plurality of contiguous adjacent folded surfaces 35 may include alternatively a tapered continuum of dimensional variation, wherein each such folded surface 35 has a cross sectional area 54, 54A, 54B, 54C, 54D, etc.,the folded surface 35 comprising the first end 38 having the smallest cross sectional area 54 and each successive folded surface therefrom having progressively larger cross sectional areas 54A, 54B, 54C, 54D, etc.

As shown in FIGS. 3E and 3F, the tapered bellows 31A contiguous adjacent folded surfaces 35A includes a section 55 which is dimensionally uniform and a further section 57 which is dimensionally tapered, wherein the first section 55 which is dimensionally uniform and the section 57 which is dimensionally tapered comprise a single sealed tapered bellows air container 31A.

The first section 55 which is dimensionally uniform has a uniform cross sectional area 58 smaller than the cross sectional area of the dimensionally tapered section 57, the dimensionally tapered section 57 varies uniformly from a smallest cross sectional area 58A, 58B, 58C, and 58D to a largest cross sectional area 58F.

The dimensionally tapered section 57 is contiguous with the dimensionally uniform section 55 such that the dimensionally tapered section 57 is smoothly joined to the dimensionally uniform section 55, with the smallest cross sectional area 58 of the dimensionally tapered section 57 being disposed nearest to the dimensionally uniform section 55.

Figure 8:
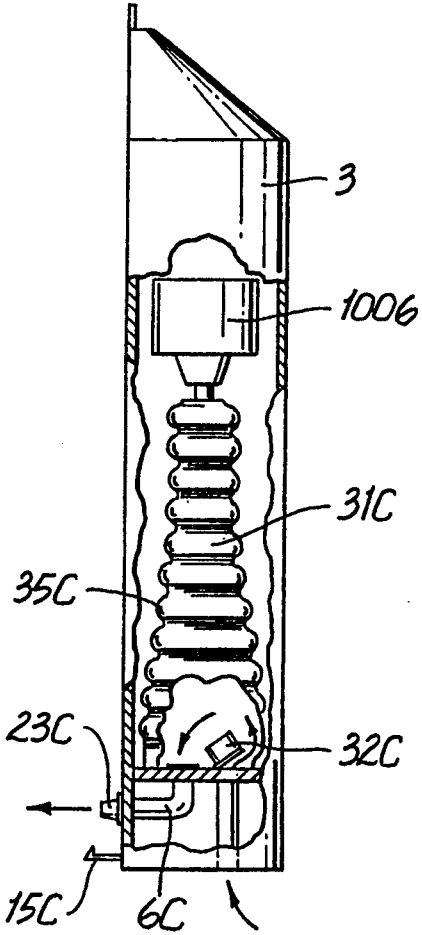
FIG. 8 is a side elevational view of a further alternate bellows pump with a weighted flap type inlet check valve at the base of the bellows.

As shown in FIG. 8, an alternate weighted flap inlet check valve 32C is provided at the base of bellows 31C, to regulate the flow of inlet air through inlet check valve 32C into bellows 31C with surfaces 35C for discharge through coupling 6C with insertion member 23C. In this embodiment release occurs with latch 15C in a manner similar to that describing the embodiment shown in FIGS. 1 and 2.

In summary, the side coupled pump module 3 is coupled to liquid module 2 in a sealable manner so that pump module 3 may be de-coupled and used with other liquid containers, without loss of significant air pressure between uses.

The foregoing description is directed towards the construction shown in the specifications and drawings herein, but basic modifications may be made, without departing from the spirit and scope of the appended Claims.

I claim:

1. An improved apparatus for discharging liquid in spray, wherein the improvement comprises:

a. a liquid module containing a liquid to be sprayed;

b. a pump module containing weight activated pumping means, said pumping means being capable of supplying compressed air wherein said weight activated pumping means is responsive to agitation of said pump module, the agitation causing a weight impart sequential impulses to said pumping means to provide pumping action;

c. said pump module and said liquid module being attachable and detachable through coupling means, said liquid module further comprising a stand alone apparatus for discharging liquids in a spray when said liquid module has been first pressurized by being attached to said pump module and then detached from said pump module after transfer of compressed air from the pumping means of said pump module to said liquid module;

d. a first conduit disposed within said liquid module and a coupling extension attached to said pump module, said coupling extension providing a connection between said pump module and said liquid module for the transfer of compressed air to the liquid module;

e. a second conduit and an outlet valve, said second conduit conducting the liquid to be sprayed from said liquid module to the outlet valve for discharge, said liquid to be sprayed flowing in response to urging by said compressed air;

f. said coupling extension of said pump module having an insertion member projecting therefrom, said insertion member being positionally disposed such that when said pump module and said liquid module are attached, said insertion member is in positional register with a liquid module sealable receiving means;

wherein said liquid module and said pump module have said coupling means comprising:

g. a finger-operated spring-loaded latch disposed in a bottom portion of said pump module;

h. an upper extension coupling tab protruding from a top portion of said pump module;

i. said latch releasable at a bottom portion of said pump module, wherein;

j. said finger-operated latch releases a bottom portion of said pump module and said liquid module from each other; thus permitting the release of the upper extension tab from a collar with a tab coupling recess, said collar being disposed at a top portion of said liquid module, the release further comprising separation of said pump module from said liquid module;

k. said extension coupling tab engages said tab coupling recess, said extension coupling tab there upon being securely held in place.

2. The apparatus as in claim 1, wherein said weight activated pumping means comprises a piston-and-cylinder pump having said weight movable within a guide means for compressing air and two check valves, including an inlet check valve and an outlet check valve, said piston being capable of compression strokes, wherein the sequential inertial impulses provided by said weight drive said piston in its compression strokes.

3. An improved apparatus for discharging liquids in a spray, wherein the improvement comprises:

a. a liquid module containing a liquid to be sprayed;

b. a pump module containing pumping means, the pumping means being capable of supplying compressed air;

c. said pump module and said liquid module being attachable and detachable, said liquid module further comprising a stand alone apparatus for discharging liquids in a spray when said liquid module has been first pressurized by being attached to said pump module and then detached from said pump module after transfer of compressed air from the pumping means of said pump module to said liquid module;

d. a first conduit disposed within said liquid module and a coupling extension attached to said pump module, said coupling extension providing a connection between said pump module and said liquid module for the transfer of compressed air to the liquid module; and e. a second conduit and an outlet valve, said second conduit conducting the liquid to be sprayed from said liquid module to the outlet valve for discharge, said liquid to be sprayed flowing in response to urging by said compressed air;

wherein said liquid module has at least one wall and has sealable receiving means disposed thereupon for sealably receiving compressed air;

wherein said pump module comprises a modular container capable of standing along on a storage shelf;

said pumping means comprising a weight activated pump;

wherein said weight activated pump is responsive to agitation of said pump module, the agitation causing a weight to impart sequential inertial impulses to said pumping means to provide a pumping action; and wherein said weight activated pump comprises a tapered bellows and two check valves, including an inlet check valve and an outlet check valve for preventing backflow of compressed air, said tapered bellows being capable of compression strokes, wherein the sequential inertial impulses provided by said weight drive said tapered bellows in its compression strokes.

4. The apparatus of claim 3 wherein said tapered bellows comprises a plurality of contiguous adjacent folded surfaces, each said contiguous adjacent folded surface being pliably capable of extensive and compressive motion relative to respective adjacent folded surfaces of said plurality of contiguous adjacent folded surfaces.

5. The apparatus of claim 4, said plurality of contiguous adjacent folded surfaces forming a pliable sealed air container having an interior, an exterior, a first end and a second end, wherein one folded surface comprises the first end and another folded surface comprises the second end of the tapered bellows, the tapered bellows further having said check valves, said check valves being a discharge exit for compressed air and an inlet for ambient air to be compressed.

6. The apparatus of claim 5, further having an axial guidance pin extending axially within tapered bellows for aligning the folding of tapered bellows surfaces during compression.

7. The apparatus of claim 5, wherein said tapered bellows contiguous adjacent folded surfaces have a thickness, a central portion and edges, each tapered bellows continuous folded surface being joined with adjacent folded surfaces at said edges.

8. The apparatus of claim 7, wherein said thickness of each folded surface varies, said thickness being at a maximum in the central portion, and at a minimum at said edges.

9. The apparatus of claim 7, wherein said tapered bellows contiguous adjacent folded surfaces have an exterior and an interior, said thickness being disposed therebetween, the exterior of the surfaces comprising the exterior of the sealed air bellows container and the interior of the surfaces comprising the interior of said sealed air bellows container.

10. The apparatus of claim 9, wherein said tapered bellows contiguous adjacent folded exterior surfaces are provided with reinforcing fibers, said reinforcing fibers being circumferentially and adheringly wrapped about and attached to said exterior surfaces, said reinforcing fibers for providing dimensional and directional guidance to said tapered bellows during compression.

11. The apparatus of claim 5, having said inlet check valve and said outlet check valve, said inlet check valve having an open position, a closed position, a flap capable of moving between the open and the closed position, and a small weight disposed upon said flap for holding said flap in the closed position, said small weight and flap being movable from the closed to the open position in response to mechanical agitation of said pump module, and from the open to the closed position in response to gravity and the mechanical agitation of said pump module.

12. The apparatus of claim 5, having said inlet check valve and said outlet check valve, said inlet check valve having an open position and a closed position, a small weight attached to a ball, said ball and an O-ring sealing means capable of moving between the open and closed position, said small weight attached to said ball for holding said O-ring sealing means in the closed position, said small weight attached to said ball and O-ring sealing means being movable from the closed to the open position in response to mechanical agitation of said pump module and movable from the open to the closed position in response to gravity and the mechanical agitation of said pump module.

13. The apparatus of claim 5, such that the plurality of contiguous adjacent folded surfaces comprise a tapered continuum of dimensional variation, wherein each such folded surface has a cross sectional area, the folded surface comprising the first end having the smallest cross sectional area and each successive folded surface therefrom having a progressively larger cross sectional area.

14. The apparatus of claim 5, wherein said tapered bellows contiguous adjacent folded surfaces comprise a first section which is dimensionally uniform and a further section which is dimensionally tapered, further wherein a. said first section which is dimensionally uniform and said section which is dimensionally tapered comprise said single sealed tapered bellows air container;

b. said first section which is dimensionally uniform having a uniform cross sectional area smaller than a cross sectional area of said dimensionally tapered section, and further where c. said dimensionally tapered section varies uniformly from a smallest cross sectional area to a largest cross sectional area, and further where d. said dimensionally tapered section is contiguous with said dimensionally uniform section such that said dimensionally tapered section is smoothly joined to said dimensionally uniform section, with the smallest cross sectional area of said dimensionally tapered section being disposed nearest to said dimensionally uniform section.

15. The apparatus of claim 5, said inlet check valve comprising said weight, a relatively narrow, elongated connecting shaft, and a guidance pin, said connecting shaft being disposed between and connecting said weight and guidance pin, said connecting shaft and said guidance pin comprising an integral compression unit capable of a vertical sealing and unsealing motion, said weight being disposed in a top position, said connecting shaft being disposed in a medial position, and said guidance pin being disposed in a bottom position within and relative to the integral compression unit, said weight further having the dual purpose of compressing air and operating said inlet check valve; said weight activated tapered bellows compressing air within the bellows in response to the sealing motion of said compression unit.

* * * * *